US006328407B1

(12) United States Patent
Sengun

(10) Patent No.: US 6,328,407 B1
(45) Date of Patent: Dec. 11, 2001

(54) METHOD AND APPARATUS OF PREWARMING A PRINTHEAD USING PREPULSES

(75) Inventor: Mehmet Z. Sengun, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/234,114

(22) Filed: Jan. 19, 1999

(51) Int. Cl.[7] ..... B41J 2/05
(52) U.S. Cl. ..... 347/17; 347/60
(58) Field of Search ..... 347/11, 14, 17, 347/60, 56, 57, 185

(56) References Cited

U.S. PATENT DOCUMENTS

| | | | | |
|---|---|---|---|---|
| 4,463,359 | | 7/1984 | Ayata et al. | 347/56 |
| 4,736,089 | | 4/1988 | Hair et al. | 347/194 |
| 4,774,530 | | 9/1988 | Hawkins | 347/63 |
| 4,791,435 | | 12/1988 | Smith et al. | 347/17 |
| 4,899,180 | | 2/1990 | Elhatem et al. | 347/59 |
| 4,980,702 | | 12/1990 | Kneezel et al. | 347/17 |
| 4,982,199 | | 1/1991 | Dunn | 347/15 |
| 5,160,403 | | 11/1992 | Fisher et al. | 438/21 |
| 5,168,284 | * | 12/1992 | Yeung | 347/17 |
| 5,281,980 | | 1/1994 | Kimuki et al. | 347/13 |
| 5,689,292 | | 11/1997 | Naohisa et al. | 347/17 |
| 5,745,132 | * | 4/1998 | Hirabayashi et al. | 347/14 |

FOREIGN PATENT DOCUMENTS

| | | |
|---|---|---|
| 0 300 634 A | 1/1989 | (EP) |
| 0 434 367 A | 6/1991 | (EP) |
| 0 496 525 A1 | 7/1992 | (EP) |
| 0 505 154 A2 | 9/1992 | (EP) |
| 63 004970 A | 1/1988 | (JP) |
| WO 90/10540 | 9/1990 | (WO) |
| WO 90/10541 | 9/1990 | (WO) |

* cited by examiner

*Primary Examiner*—Craig A. Hallacher
(74) *Attorney, Agent, or Firm*—Oliff & Berridge, PLC

(57) ABSTRACT

A method and apparatus of warming a printhead with a heat sink using prepulsing is provided. A temperature of the printhead may be measured and then using predetermined data, an amount of prewarming of the printhead may be determined based on the measured temperature. The printhead may be prewarmed by prepulses based on the determined amount of prewarming prior to printing a swath of data. The swath of data may then be printed and the temperature of the printhead may again be measured to determine a subsequent temperature and amount of prewarming. The printhead may again be prewarmed prior to printing subsequent swath by applying prepulse signals which are determined based on the subsequent temperature of the printhead. The thermal mass of the heat sink may be used for the advantage of minimizing the amount of required prewarming, and therefore, maximizing the productivity, when the ambient temperature is low.

20 Claims, 9 Drawing Sheets

PREHEAT TIME vs. TCO READING FOR TARGET OPERATING TEMPERATURE OF 25° C

TEMPERATURE HISTORY FOR FIRST TWO SWATHS FOR BLACK INK

TEMPERATURE HISTORY FOR FIRST TWO SWATHS FOR COLOR INK

METHOD AND APPARATUS OF PREWARMING A PRINTHEAD USING PREPULSES

BACKGROUND OF THE INVENTION

1. Field of Invention

The present invention relates to ink jet printers and more particularly relates to controlling spot sizes by applying prepulses to a printhead.

2. Description of Related Art

A thermal ink jet printhead selectively ejects droplets of ink from a plurality of drop emitters to create a desired image on an image receiving member, such as a sheet of paper. The printhead typically comprises an array of the drop emitters that convey ink to the image receiving member. In a carriage-type ink jet printhead, the printhead moves back and forth relative to the image receiving member to print the image in swaths. Alternatively, the array may extend across the entire width of the image receiving member to form a full-width printhead. Full-width printheads remain stationary as the image receiving member moves in a direction substantially perpendicular to the array of drop emitters.

An ink jet printhead typically comprises a plurality of ink passageways, such as capillary channels. Each channel has a nozzle and is connected to an ink supply manifold. Ink from the manifold is retained within each channel until, in response to an appropriate signal applied to a resistive heating element in each channel, the ink and a portion of the channel adjacent to the heating element is rapidly heated and vaporized. Rapid vaporization of some of the ink in the channel creates a bubble that causes a quantity of ink (an ink droplet or a main ink droplet and smaller satellite drops) to be ejected from the emitter to the image receiving member. U.S. Pat. No. 4,774,530 to Hawkins, the disclosure of which is incorporated herein by reference, shows a general configuration of a typical ink jet printhead.

When a quantity of ink in the form of a droplet is ejected from the ejector to a copy surface, the resulting spot becomes part of a desired image. Uniformity in spot size of a large number of droplets is very important for image quantity. If the volume of droplets ejected from the printhead over the course of producing a single document are permitted to vary widely, the lack of uniformity will have noticeable effects on the quality of the image. Similarly, if volumes of droplets ejected from the printhead differ during subsequent printings of the same document, then printing stability cannot be maintained; this is particularly important in color printing. The most common and important cause of variance in the volume of droplets ejected from the printhead is variations in the temperature of the printhead over the course of use. The temperature of the liquid ink, before vaporization by the heating element, substantially affects both the nucleation behavior and the viscosity of the ink. These two properties substantially influence the resulting spot size on the copy surface. Control of temperature of the printhead has long been of primary concerns in the art.

In order to maintain a constant spot size from an ink jet printhead, various strategies have been attempted. One example is U.S. Pat. No. 4,899,180 to Elhatem et al., the disclosure of which is incorporated herein by reference. In this patent the printhead has a number of heater resistors and a temperature sensor which operate to heat the printhead to an optimum operating temperature and maintain that temperature regardless of local temperature variations.

U.S. Pat. No. 4,791,435 to Smith et al. the disclosure of which is incorporated herein by reference, discloses an ink jet system wherein the temperature of the printhead is maintained by using the heating elements of the printhead not only for ejection of ink but for maintaining the temperature as well. The printhead temperature is compared to thermal models of the printhead to provide information for controlling the printhead temperature. At low temperature, low energy pulses are sent to each channel, or nozzle, below the voltage threshold which would cause a drop of ink to be ejected. Alternatively, the printhead is warmed by firing some droplets of ink into an external chamber or "spittoon," as opposed to the copy surface.

PCT Application 90/10541, the disclosure of which is incorporated herein by reference, describes a printhead in which the heating cycle for the ink is divided into several partial cycles, only the last of which initiates bubble formation and ejection of a droplet. In this printhead, therefore, the liquid ink is first preheated to a preselected temperature, wherein the ink will have known volume and viscosity characteristics so that the behavior of the ink will be predictable at the time of firing.

PCT Application 90/10540, the disclosure of which is incorporated herein by reference, discloses a printhead control system wherein the temperature of the liquid ink is compared with a predetermined threshold value, and if it exceeds this threshold value, the pulse energy (proportional to the square of the voltage to the heating element times the time duration of the pulse) is reduced. According to this patent, the pulse energy may be varied by controlling either the voltage, the pulse duration, or both.

U.S. Pat. No. 4,736,089 to Hair et al., the disclosure of which is incorporated herein by reference, discloses a thermal printhead (as opposed to an ink-jet printhead) wherein the printhead temperature is sensed by a voltage generating diode on the printhead itself A detected temperature of the printhead is used to establish a preselected reference level. Bi-stable means are coupled to the thermal printhead to print or not print at a given time. Control means are used to turn the bi-stable means on when the controlled voltage is less than the reference level related to the temperature, and turn the bi-stable means off when the controlled voltage exceeds the preselected reference level, thus causing the time duration of a voltage pulse to the thermal printing means to be dependent on temperature.

U.S. Pat. No. 4,980,702 to Kneezel, the disclosure of which is incorporated herein by reference, discloses a thermal ink jet printhead wherein outputs from a temperature sensor in the printhead are compared to a high or low level temperature reference. If the sensed printhead temperature is below the reference value, power to the heater in the printhead is turned on. If the temperature sensed is too high, the heater is turned off. The printhead is configured so that the temperature sensor and heater in the printhead are in close proximity.

U.S. Pat. No. 4,982,199 to Dunn, the disclosure of which is incorporated herein by reference, discloses a method and apparatus for gray scale printing with a thermal ink pen. A firing resistor is driven by a plurality of pulses to eject a droplet of ink from a nozzle. Prewarming of the ink in the firing chamber is achieved by applying an electrical warming pulse signal to the resistor prior to a firing pulse signal. The firing pulse signal causes the drop to be ejected. The warming pulse may be a plurality of pulses applied sequentially prior to the firing pulse which transfers a desired quantity of thermal energy to the ink. The prewarming of the ink by the warming pulse or pulses increases the volume of the ink droplet. By varying the degree of prewarming the droplets ejected by the firing pulse can be varied in volume, yielding gray scale printing.

European Patent Application No. 0 496 525 A1, the disclosure of which is incorporated herein by reference, discloses an ink jet recording method and apparatus in which ink is ejected by thermal energy produced by a heat generating element of a recording head. According to one aspect, driving means apply plural driving signals to the heat generating element for every ink droplet ejected. The plural driving signals include a first driving signal for increasing a temperature of the ink adjacent the heater without creating the bubble, and a second driving signal subsequent to the first driving signal with an interval therebetween, for ejecting the ink. Additionally, a width of the first driving signal is adjustable so as to change an amount of the ejected ink.

European Patent Application No. 0 505 154 A2, the disclosure of which is incorporated herein by reference, discloses a thermal ink jet recording method and apparatus which controls an ink ejection quantity by changing driving signals supplied to the recording head on the basis of a variation in temperature of the recording head. A preheat pulse is applied to the ink for controlling ink temperature and is set to a value which does not cause a bubble forming phenomenon in the ink. After a predetermined time interval, a main heat pulse is applied which forms a bubble in the ink to cause ejection of a droplet (or a main droplet and satellite drops) of ink from an ejection port.

U.S. patent application No. 08/220,720 to Stephany, the disclosure of which is incorporated herein by reference, discloses a power control system for a printer which has at least one heating element for producing spots. The system includes a thermistor disposed on a printhead which senses the temperature of the printhead. The sensed temperature is used to vary pulses applied to the at least one heating element to maintain a constant spot size.

SUMMARY OF THE INVENTION

The present invention may provide a method and apparatus of using a printhead attached to a heat sink having a plurality of drop ejectors. Each ejector may have a heating element actuable in response to input signals to emit a quantity of ink from the printhead toward an image receiving member. A temperature on the printhead may be measured using a measuring device located in the vicinity of the channels of the printhead. Then, an amount of prepulse before the main pulse may be determined based on the measured temperature to stabilize the drop volume over a certain temperature window.

However, when the ambient temperature is too low, prepulsing is not enough to control the drop volume. Then, the printhead and a small portion of the heat sink may be prewarmed before the beginning of each print line based on the measured temperature using only prepulses, until the operating temperature window is reached.

Other objects, advantages and salient features of the invention will become apparent from the following detailed description taken in conjunction with the annexed drawings, which disclose preferred embodiments of the invention.

BRIEF DESCRIPTION OF THE DRAWINGS

The invention will be described with reference to the following drawings in which like reference numerals refer to like elements and wherein.

DETAILED DESCRIPTION OF PREFERRED EMBODIMENTS

Figure 1:
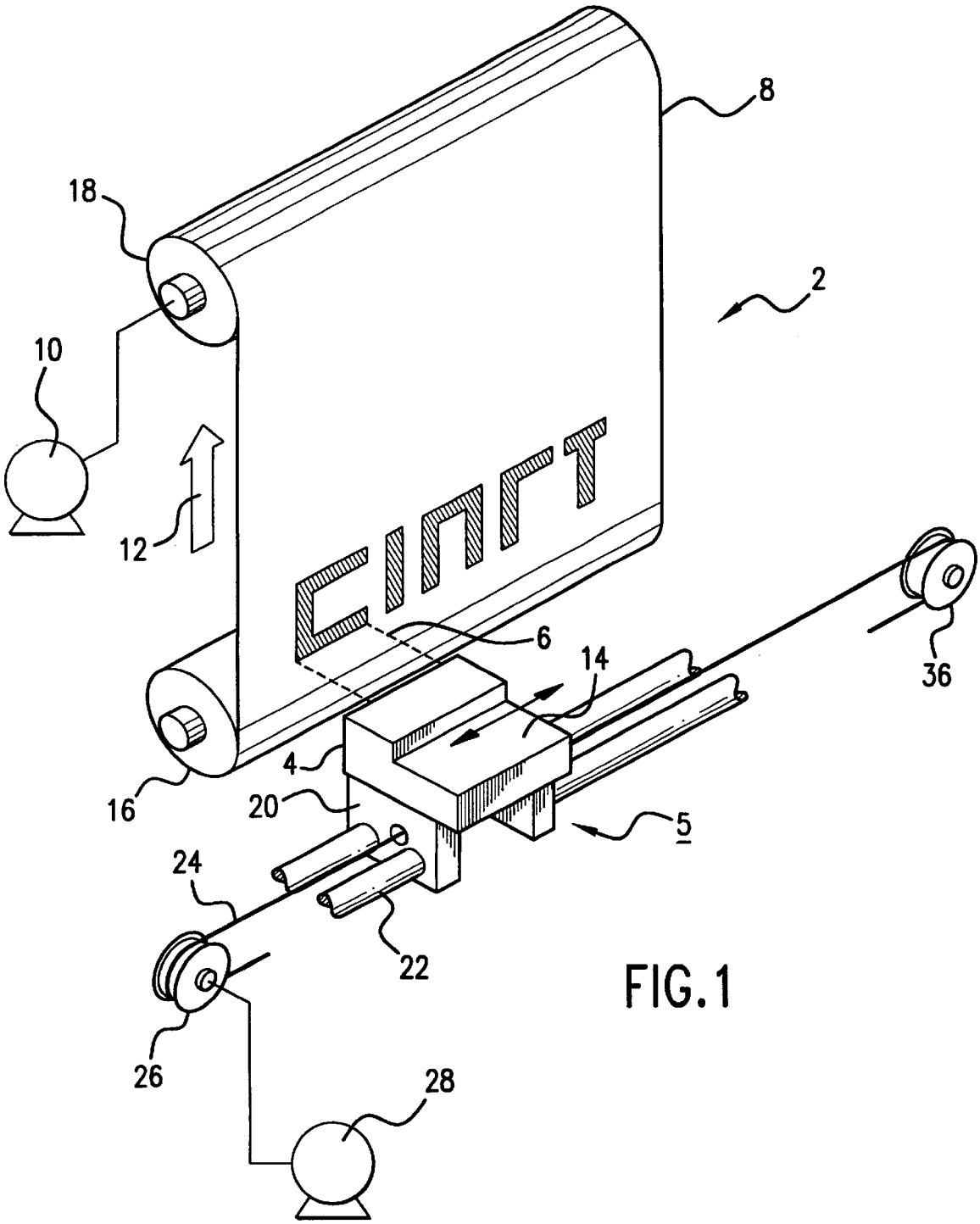
FIG. 1 is a schematic view of a prior art printing system.

FIG. 1 shows a typical carriage-type ink jet printing device 2. A linear array of droplet producing channels is housed in the printhead 4 of the reciprocal carriage assembly 5. Ink droplets 6 are propelled to a receiving medium 8 (such as a sheet of paper) that is stepped by a motor 10 a preselected distance in a direction of arrow 12 each time the printhead 4 traverses across the receiving medium 8 in the directions indicated by arrow 14. The receiving medium 8 can be stored on a supply roll 16 and stepped onto takeup roll 18 by stepper motor 10 or other means well known to those of skill in the art.

The printhead 4 is fixedly mounted on the support base 20, which is adapted for reciprocal movement using any well known means, such as two parallel guide rails 22. The reciprocal movement of the printhead 4 may be achieved by a cable 24 and a pair of pulleys 26, one of which is powered by a reversible motor 28. The printhead 4 is generally moved across the receiving medium 8 perpendicularly to the direction the receiving medium 8 is moved by the motor 10. Of course, other structures for reciprocating the carriage assembly 5 are possible.

Alternatively, the linear array of droplet producing channels may extend across the entire width of the receiving medium 8 as is well known to those of skill in the art. This is typically referred to as a full-width array. See, for example, U.S. Pat. No. 5,160,403 to Fisher et al. and U.S. Pat. No. 4,463,359 to Ayata et al., the disclosures of which are incorporated herein by reference.

Figure 2:
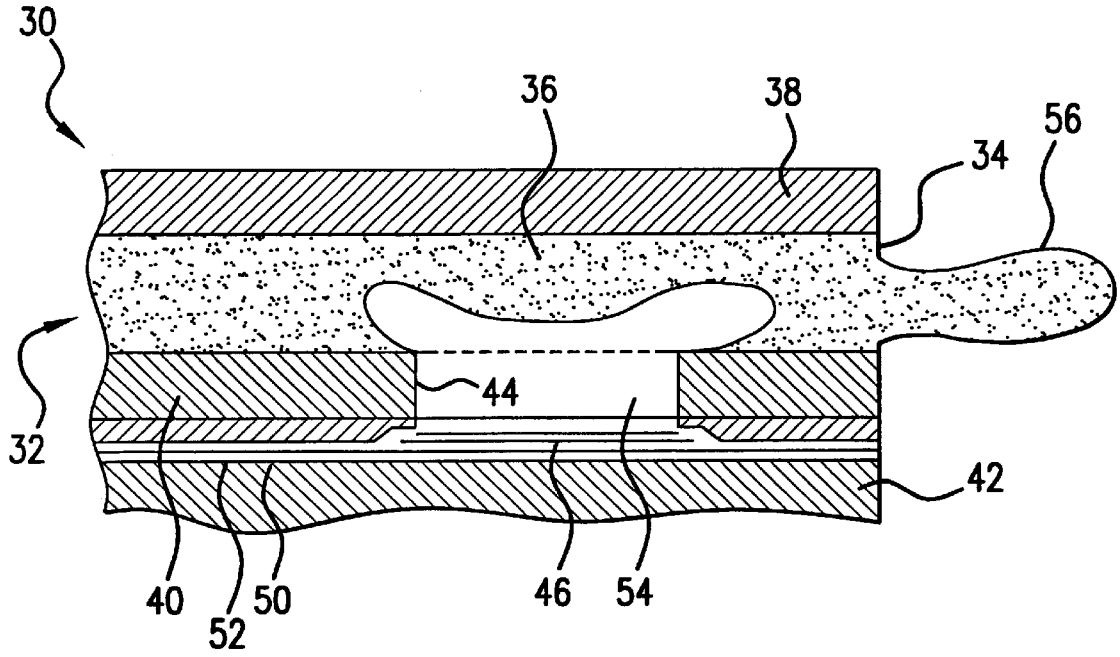
FIG. 2 is a cross-sectional view of a single ejector channel for a prior art ink jet printhead.

FIG. 2 shows an ink droplet emitter 30 (or ejector) of one embodiment of a typical ink jet printhead, one of a large plurality of such emitters found in an ink jet printhead. While FIG. 2 shows a side-shooter emitter, other emitters such as roof-shooter emitters may similarly be used with the present invention. Typically, such emitters are sized and arranged in linear arrays of 300 to 600 emitters per inch although other dimensions are known to one skilled in the art. A silicon member having a plurality of channels for ink droplet emission is known as a "die module" or "chip". Each die module typically comprises hundreds of emitters, spaced 300 or more to the inch. An ink printhead may have one or more die modules forming a full-width array extending the full width of the receiving medium on which the image is to be printed. In printheads with multiple die modules, each die module may include its own ink supply manifold, or multiple die modules may share a common ink supply manifold.

Each emitter 30 includes a capillary channel 32 terminating in an orifice or nozzle 34. The channel 32 holds a quantity of ink 36 maintained within the capillary channel 32 until such time as a droplet of ink is to be emitted. Each capillary channel 32 is connected to a supply of ink from an ink supply manifold (not shown). The upper substrate 38 abuts a thick film layer 40, which in turn abuts a lower substrate 42.

Sandwiched between the thick-film layer 40 and the lower substrate 42 are electrical heating elements 46 for ejecting ink droplets from the capillary channel 32 in a well know manner. The heating element 46 may be located within a recess 44 formed by an opening in a thick film layer 40. The heating element 46 may be electrically connected to an addressing electrode 50. Each of the ejectors 30 in the printhead 4 may have its own heating element 46 and individual addressing electrode 50. The addressing electrode 50 may be protected by a passivation layer 52. Each addressing electrode 50 and heating element 46 may be selectively controlled by control circuitry, as will be explained in detail below. Other embodiments of the ink jet printhead are well known to one skilled in the art and are also within the scope of this invention.

As is well as known in the art, when a signal is applied to the addressing electrode 50, the heating element 46 is energized. If the signal is of a sufficient magnitude and/or duration, the heat from the resistive heating element 46 will cause the liquid ink immediately adjacent the heating element 46 to vaporize, creating a bubble 54 of vaporized ink. The force of the expanding bubble 54 ejects an ink droplet 56 (which may include a main droplet and smaller satellite drops) from the orifice 34 onto the surface of the receiving medium 8.

Thermal ink jet printheads may apply a plurality of pulses to the heating element 46 for each ink droplet 56. Typically, one or more precursor pulses (also hereafter called warming pulses or prepulses) may be applied by the heating element 46 to warm the ink adjacent thereto. Subsequently, a print pulse (also hereafter called drive pulse, firing pulse or main pulse) may be applied to the heating element 46. The print pulse causes the ink droplet 56 to be ejected. The prepulse signals may be used to raise the temperature of the ink adjacent the heating element 46 and additionally may be used to control the volume of ink droplet 56. The prepulse signals do not contain enough energy to cause the ink droplet 56 to be emitted.

Figure 3:
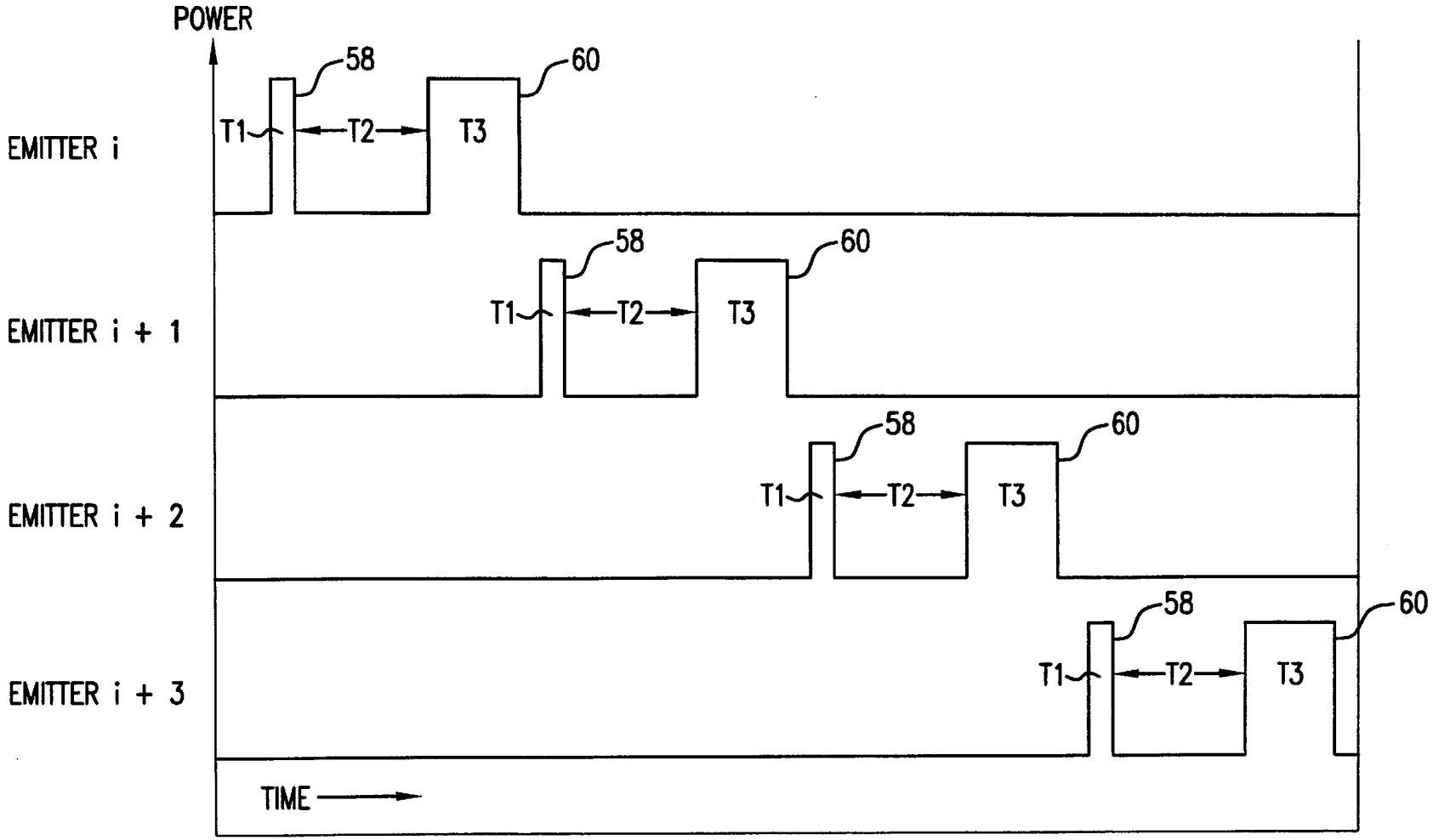
FIG.3 (PRIOR ART)
FIG. 3 is a timing diagram showing how pulses are applied in the prior art printing device to banks of emitters.

FIG. 3 is a prior art timing diagram showing how a prepulse signal and a firing signal (or main pulse signal) are applied to emitters (or emitter banks) according to a conventional thermal ink jet printhead. A precursor pulse 58, having a duration TI may be applied to an emitter i (or emitter bank i) to warm the ink and/or to control a size of the droplet to be ejected. This may be followed by a relaxation time of duration T2. Then, a print pulse 60 of duration T3 is applied to the emitter i. Subsequently, another precursor pulse 58 followed by a relaxation time and a print pulse 60 may be applied to emitter i+1 (or emitter bank i+1). This process may continue across a printhead in serial fashion until all the emitters (or emitter banks) required to eject drops of ink have been addressed.

Figure 4:
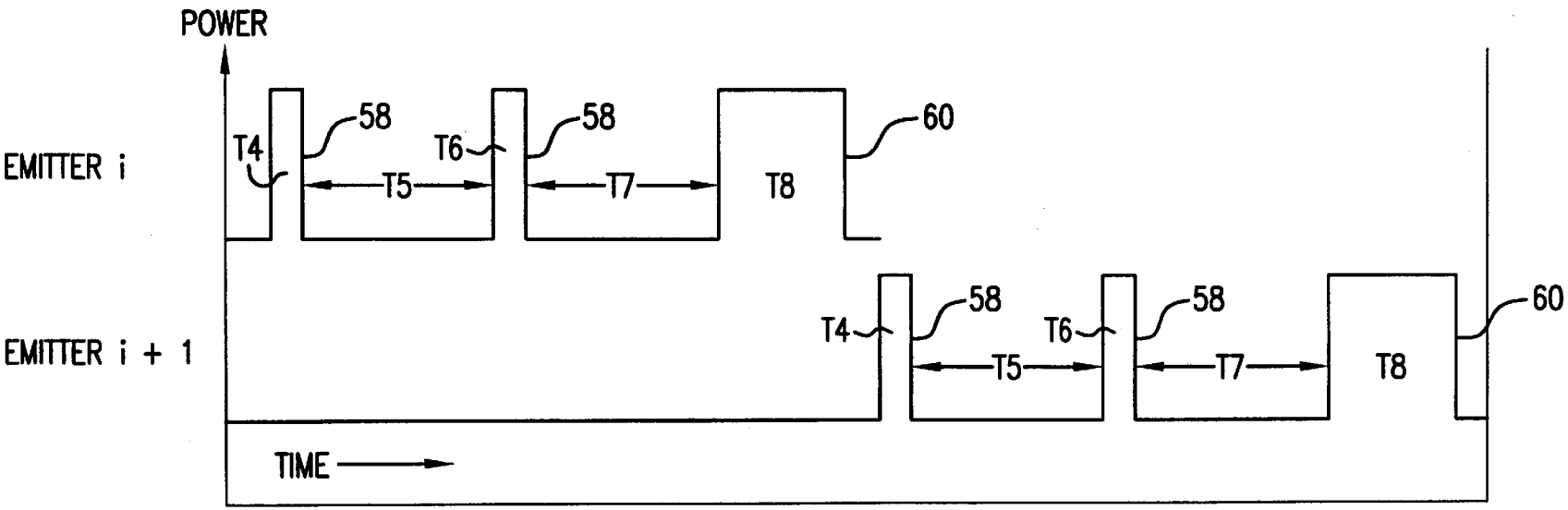
FIG. 4 (PRIOR ART)
FIG. 4 is a timing diagram showing how pulses are applied in a prior art printing device to banks of emitters.

FIG. 4 is a prior art timing diagram similar to FIG. 3 except that in FIG. 4 multiple precursor pulses 58 are applied to each emitter i (or emitter bank i) prior to the print pulse 60. The multiple precursor pulses 58 are shown having duration T4 and T6, respectively and are separated from each other by a relaxation time of duration T5. The print pulse 60 is shown having a duration T8 and is separated from the second precursor pulse by a relaxation time of duration T7. The durations of all the pulses and relaxation times may vary as required. Similar to the timing diagram shown in FIG. 3, the pulses may be applied sequentially to a single emitter i (or emitter bank) and then may be sequentially applied to the other emitters i (or emitter banks) as required to eject the necessary droplets of ink. U.S. patent application Ser. No. 08/864,893, the disclosure of which is incorporated herein by reference, discloses a method and apparatus of applying pulses to a first emitter and a second emitter such that the pulses supplied to the first emitter are interleaved in time with the pulses supplied to the second emitter.

The size of the spot created by a droplet 56 on a copy sheet may be a function of both the physical quality of the ink at the point just before vaporization, which is largely a function of the temperature of the ink, and the kinetic energy with which the droplet is ejected, which is a function of the electrical energy to the heating element 46. Thus, in accordance with the present invention, the power to the heating element 46 can be made dependent on a sensed temperature of the liquid ink. That is, a sensed temperature of the printhead (or on the printhead) may be used to control the power level and/or time duration of prepulses.

The ambient operating temperature range for desk top network printers is normally between 10° C. and 35° C. and more preferably is approximately 25° C. The temperature of the die module together with the heat sink may actually reach much higher temperatures for prolonged print jobs (~60° C.). The temperature swing can lead to printhead failure or significant degradation in print quality. Accordingly, a prepulse control method based on the printhead temperature reading may be used to remedy the situation by stabilizing the drop volume. However, this control window is usually not big enough to cover the required temperature range (10° C.–60° C.), but it may cover a range from 25° C. to 60° C., for example.

A prewarming approach may extend the operating temperature range by firing sub-threshold pulses (or prepulses) to heat the printhead when the temperature is low (e.g., below 25° C.). The lower the temperature, the longer the prewarming time which reduces to zero as the temperature of the printhead reaches the lower end of the normal operating window (e.g., 25° C.). The temperature may be measured before printing starts and then the whole printhead including the heat sink may be prewarmed to the desired uniform temperature. However, this may take a long time depending on the thermal mass of the heat sink. This is a problem, especially if the print job includes only a couple of pages.

Another approach is to preheat only the chip and the tip of the heat sink for a short period of time before the beginning of each swath. This would make the prewarming process essentially transparent to the user. This process is time dependent and several different thermal time scales may need to be considered for a successful operation.

Figure 5:
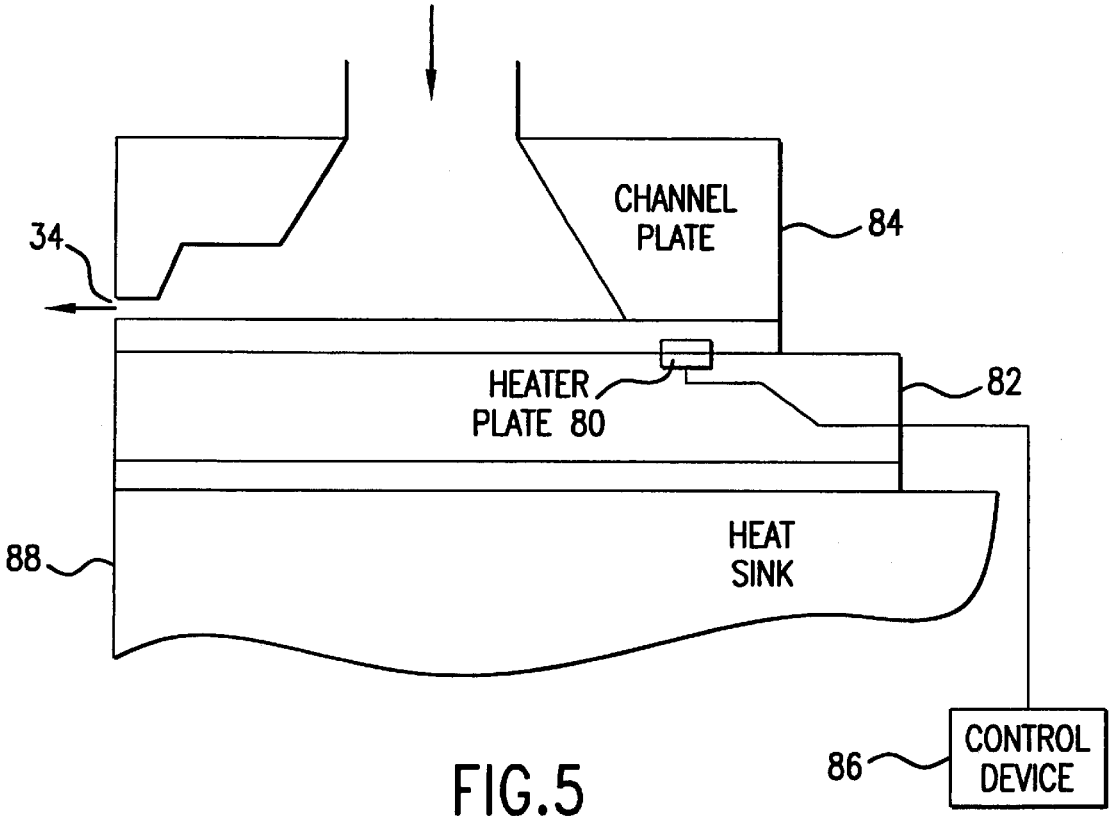
FIG. 5 is another schematic view of the printhead geometry.

FIG. 5 shows an embodiment of a printhead similar to that of FIG. 2. FIG. 5 shows a TCO (Temperature Controlled Oscillator) 80 located at the back of the heater plate 82, which is attached to a heat sink 88 with a thermally conductive adhesive. TCO 80 may be located at different locations within the printhead as is known to one skilled in the art. Ink emerges through the channel plate 84 and out through the orifice 34 in a well known manner similar to that described above with respect to FIG. 2. Based on the reading of the TCO 80, a control device 86 may determine a number of prepulse signals to be applied to the heating element 46

(shown better in FIG. 2) for prewarming purposes based on predetermined data. These number of applied prepulses (or prepulse signals) may be fired before the beginning of each swath of image data. If the print area coverage on the image receiving medium 8 is high, then the chip will respond quickly and prewarming may not be necessary for the rest of the document. However, if the print area coverage on the image receiving medium 8 is very low, then the chip may cool off due to conduction of heat into the heat sink 88. Thus, the amount of prewarming may be determined so the chip is somewhat overheated initially and such that the temperature at the critical point remains above a certain temperature after a cooling period of above 0.5 seconds, which corresponds to about one swath of image data. The location of the critical temperature that controls the spot size may be determined experimentally. For the particular printhead design shown in FIG. 5, the critical temperature is somewhat upstream of the channels and is preferably under the front terrace of orifice 34 as shown in FIG. 5. The print quality may be acceptable if this temperature falls down to several degrees below the target temperature (i.e., the lower end of the prepulse control range).

As explained previously, the temperature of the heat sink will rise over a period of printing. If the printer is used somewhat frequently where the ambient temperature is too low, the thermal inertia of the heat sink may keep the printhead warm and within the normal operating temperature window between separate print jobs. In this case, prewarming would only be necessary during perhaps the initial pages of the first print job, and the printer would print at its maximum speed for the rest of the day. This is in contrast to printhead designs that do not employ a heat sink and would, therefore, practice prewarming much more frequently.

Figure 6:
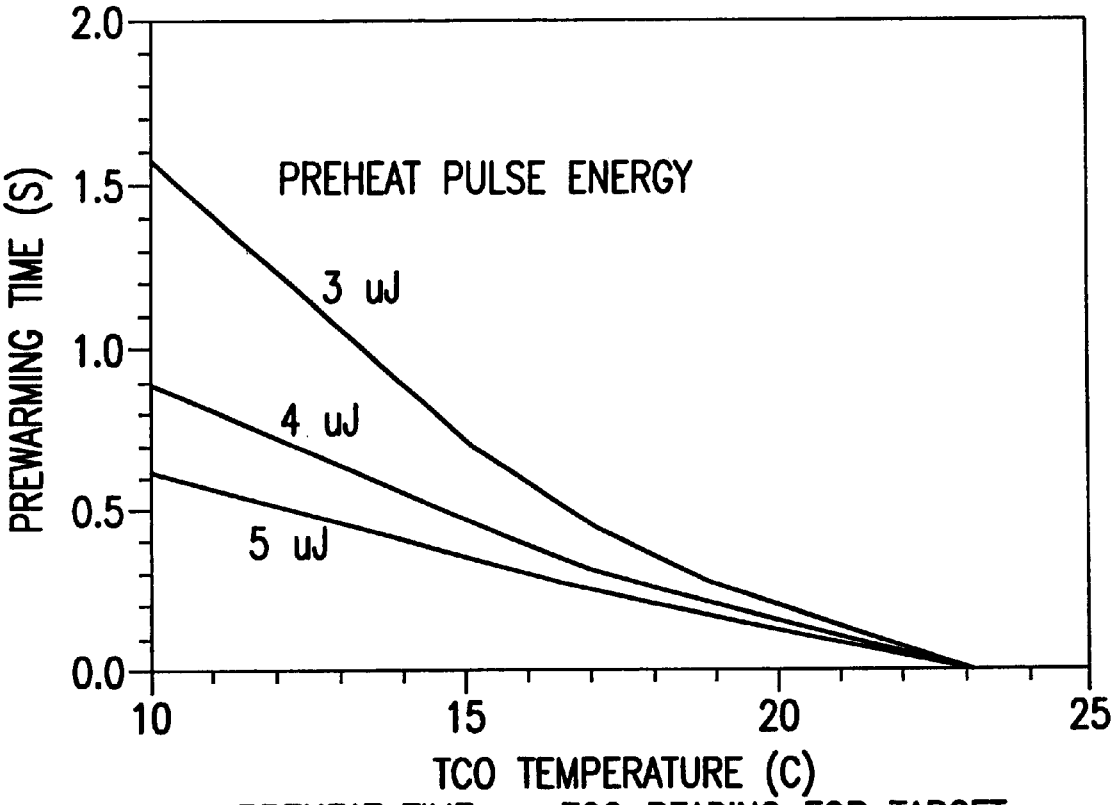
FIG. 6 is a diagram showing the preheat time and TCO reading for a target operating temperature of 25° C.

The amount of maximum preheat pulse energy to fire one jet depends on characteristics of the ink and the drop ejector design, but it is typically in the several $\mu$J range. Besides, only a portion or all of this energy may be preferred for prewarming purposes. Data regarding the preheating (or prewarming) amount and the TCO readings for a target temperature of 25° C. are shown in FIG. 6. That is, three-dimensional numerical simulations were carried out to obtain the prewarming curves corresponding to pulse energies of 3 $\mu$J, 4 $\mu$J and 5 $\mu$J for a target of 25° C. for the printhead shown in FIG. 5 operating at 12 kHz. In this particular case, the 4 $\mu$J curve for the black ink and 3 $\mu$J curve for the color ink are the preferred choices of about half the nominal values to prevent premature nucleation. The data of FIG. 6 depends on the printhead geometry, the TCO location and the pulsing frequency. If one of these parameters is different, then the data of FIG. 6 may need to be calculated again. From FIG. 6, the control device 86 can determine the amount of necessary prewarming time based on the sensed temperature of the TCO 80. For example, for black ink at a TCO temperature of 10° C., approximate 0.9 seconds of prewarming time is necessary for a 12 kHz pulse signal. Data of FIG. 6 is preferably stored within the control device 86, which also controls overall operation of the printhead as is known to one skilled in the art. The control device 86 is preferably implemented on a programmed general purpose computer. However, the control device 86 can also be implemented on a special purpose computer, a programmed microprocessor or microcontroller and peripheral integrated circuit elements, an ASIC or other integrated circuit, a hardwired electronic or logic circuit such as a discrete element circuit, a programmable logic device such as a PLD, PLA, FPGA or PAL, or the like.

Under normal operation, the initial temperature of the printhead may be determined using the TCO 80 or similar temperature measuring device well known to one skilled in the art. The control device 86 may then determine the amount of prewarming using the particular TCO temperature and predetermined data such as that shown in FIG. 6. The FIG. 6 data need not be in the form of a curve within the control device 86 but may also be in the form of a lookup table or similar type of data recording means. The prepulse signals are then applied to a heating element 46 within the printhead to appropriately warm the printhead without any ink being ejected from the printhead. Because the data shown in FIG. 6 is known to the control device 86 prior to use, the control device 86 is not required to remeasure the temperature using the TCO 80 immediately after applying the prewarming pulses and prior to printing the swath. That is, the control device 86 inherently knows that the temperature of the printhead will have exceeded the predetermined temperature at the end of the prewarming operation based on the stored data. However, if appropriate, the control device 86 may double-check the data by rereading the TCO 80 between applying the prewarming pulses and starting to print the current swath.

Immediately after prewarming, the main pulses together with appropriate prepulses are applied to the respective heating elements 46 as the carriage assembly carrying the printhead moves across a scan line so as to eject ink and form image data on the image recording medium 8. At the end of the swath of data, the control device 86 may again sense the temperature on the printhead using the TCO 80. If the temperature of the printhead is below a predetermined value, such as 25° C., then the control device 86 again determines the amount of prewarming which may be necessary for that printhead. That is, if the temperature is sufficiently low, the printhead uses the data such as in FIG. 6 to determine the amount of prewarming. The appropriate amount of subsequent prepulse signals are then supplied to the heating elements. After the application of the respective number of preheat pulses (or prewarming time), the carriage assembly carrying the printhead may print another swath of image data and return towards its initial position in a reverse direction. Main pulse and prepulse signals are applied to the heating elements so as to print the second swath of data on the image receiving medium 8.

At the end of the second swath of data, the cycle may be repeated again by: a) measuring the temperature of the printhead using the TCO 80; b) determining whether any prewarming is necessary using data such as in FIG. 6; c) applying appropriate number of prepulse signals to the heating elements 46 if the temperature is less than a predetermined level; and d) applying main pulse and prepulse signals as the carriage assembly moves across the scan line so as to eject ink onto the image receiving medium 8. In certain applications, printing may be unidirectional. That is, ink may be ejected onto the image receiving medium 8 while the carriage assembly moves only from left to right (or in the reverse direction) and no ink is ejected in the return stroke. In such a case, steps (a) through (d) are exercised only right before the stroke where image recording is accomplished. Naturally, if a full-width linear array of ejectors is used, then the carriage assembly would not move relative to the image receiving medium 8. Furthermore, the present invention includes the ability to measure a TCO temperature after each swath of data or any group of image data that may be printed.

Figure 7:
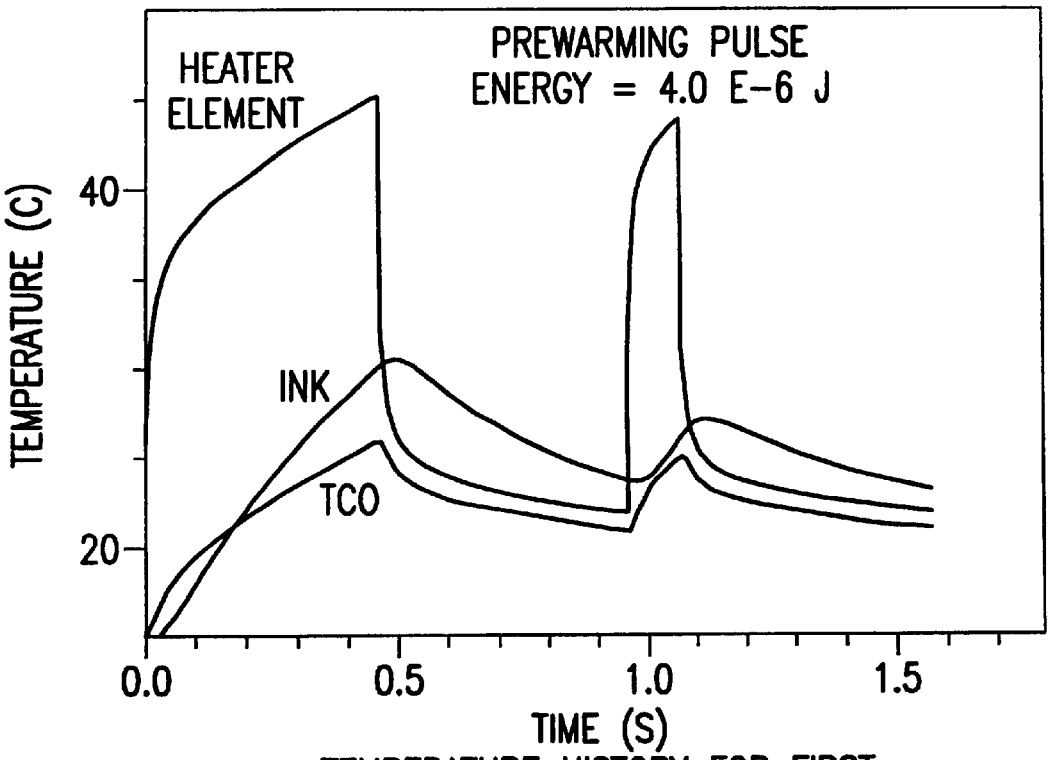
FIG. 7 is a diagram showing the temperature history for two swaths of black ink according to a preferred embodiment of the present invention.
Figure 8:
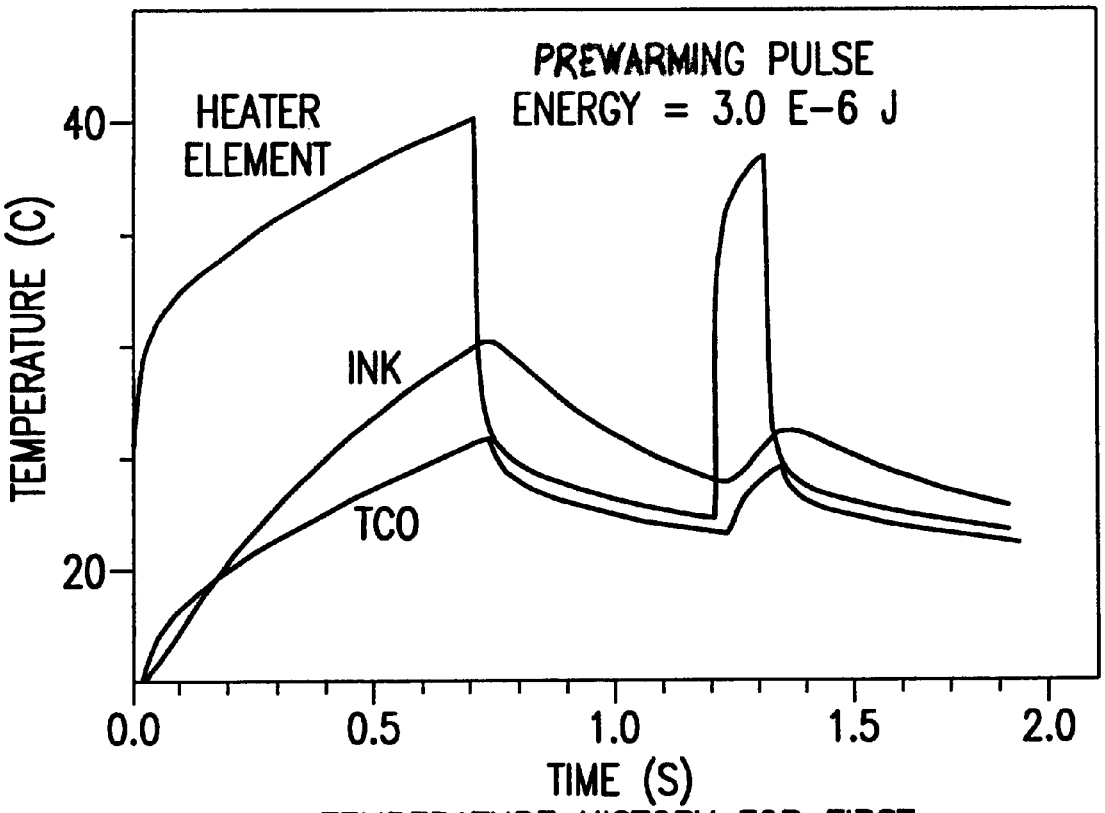
FIG. 8 is a diagram showing the temperature history for two swaths of color ink according to a preferred embodiment of the present invention.

Typical temperature time histories for black ink and color inks are shown in FIGS. 7 and 8, respectively, for the first two swaths of data for printing at an ambient temperature of 15° C. For black ink (FIG. 7), the printhead is initially at a uniform temperature so the TCO reading corresponds to the ambient temperature, which requires about half a second of preheating based on the FIG. 6 data. At the end of the first swath (i.e., after about 0.5 seconds), the ink temperature may drop to about 23° C. if the print density is very low. Thus, before the second swath of image data is printed at approximately one second, the TCO reading is about 21° C., which requires a preheat time of about 0.1 seconds based on the FIG. 6 data. Thus, the temperature at the end of the second swath is about the same as the first swath indicating the temperature control can be maintained for further printing as well. Thus, productivity may be determined by the interswath preheating rather than an initial temperature of the printhead.

Figure 9:
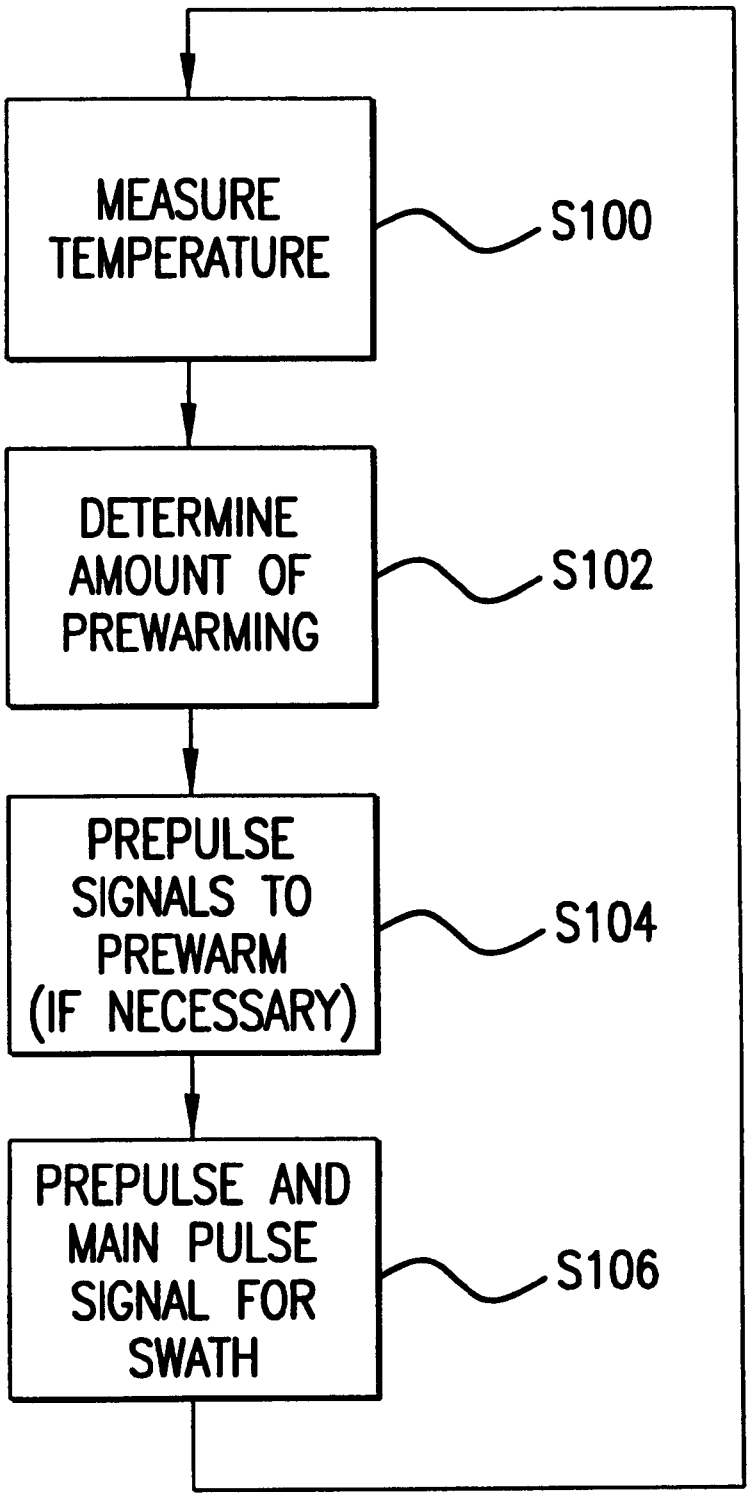
FIG. 9 is a flow chart showing a preferred embodiment of the present invention.

FIG. 9 shows a flow chart of the preferred method of the present invention which is performed using the control device 86. In step S100, the temperature of the printhead is measured by the TCO 80. Then, the control device 86 determines the amount of prewarming in step S102 using the data such as that shown in FIG. 6. In step S104, the prepulse signals (if any) are applied to the heater elements 46 to prewarm the printhead by the necessary amount. And finally in step S106, the prepulse and main pulse signals are supplied to the respective heater elements 46 to print a swath of data preferably by moving the carriage assembly 5 across the image receiving medium 8. At the end of the first swath of data, the method returns to step S100 to repeat the process for the second swath of data. This cycle of steps S100–S106 may be repeated for each swath of data or may be discontinued after a predetermined number of swaths has been printed or a predetermined temperature of the printhead has been reached.

The printing system may include multiple printheads and multiple TCOs. Each of the TCOs may measure a different printhead temperature, which may then require different prewarming for the respective printheads based on FIG. 6 data. Furthermore, each of the printheads may operate under different parameters such as a maximum prepulse energy of 3 $\mu$J for a first printhead and 5 $\mu$J for a second printhead. If multiple printheads are present, they usually travel together. In that case, it may be preferred to keep the prewarming time the same for all the printheads. Under such conditions, the control device 86 may operate such that the maximum allowable prepulse energy is used for the printhead that requires the longest prewarming time, and only a portion of the allowable prepulse energy is used for another printhead keeping the prewarming time the same. The necessary information can be obtained from data such as shown in FIG. 6. As an example, let's assume that the TCO reading indicates a temperature of 10° C. for Printhead-A and 15° C. for Printhead-B. Let us further assume that the maximum allowable prepulse energy is 5 $\mu$J for both printheads. From FIG. 6, the prewarming time may be approximately 0.6 seconds for both printheads, but Printhead-A may be prepulsed at the maximum 5 $\mu$J, whereas Printhead-B may be prepulsed at approximately 3.5 $\mu$J, that is, at 70% of maximum capacity. Other embodiments of prewarming both printheads may also be accomplished by this invention.

While the invention has been described in relation to preferred embodiments, many modifications and variations are apparent from the description of the invention. All such modifications and variations are intended to be within the scope of the present invention as defined by the appended claims.

What is claimed is:

1. An ink jet assembly comprising:

a printhead employing a heat sink and having a plurality of drop ejectors, each drop ejector having an ejector heating element actuable in response to input signals to emit a quantity of ink from the printhead;

a power supply that supplies prepulse signals and firing signals to the heating elements;

at least one measuring device provided within the printhead to measure a temperature of the printhead, the measuring device outputting a signal corresponding to the measured temperature; and a control device that receives the signal output from the measuring device, the control device connecting the power supply to the ejector heating element so as to supply the prepulse signals and firing signals, the control device controlling prewarming of the printhead by applying prepulse signals to at least one ejector heating element based on the measured temperature, the control device printing by supplying at least one prepulse signal to at least one ejector heating element, based only on at least one of the measured temperature and prewarming pulses immediately prior to printing, prior to supplying a main pulse to the printing ejector element.

2. The apparatus of claim 1, wherein the control device determines the number of applied pulse signals based on the measured signal and predetermined data regarding the printhead.

3. The apparatus of claim 1, wherein the control device applies the main pulse signals to the heating element so as to emit ink from the printhead toward an image receiving member, the control device further controlling movement of the printhead across the image receiving member to print a swath of image data.

4. The apparatus of claim 3, wherein upon printing a swath of data, the control device receives a signal from the measuring device indicating the temperature of the printhead and controls a subsequent prewarming operation of the printhead based on temperature of the printhead.

5. The apparatus of claim 1, wherein the control device includes a memory device for storing data regarding operating parameters of the printhead, the control device using the stored data to determine the amount of prewarming.

6. The apparatus of claim 1, wherein the at least one measuring device is located within at least one fluid channel of the printhead.

7. A method of stabilizing drop volume of a thermal fluid ejector assembly by maintaining a temperature within the thermal fluid ejector assembly that is within an operating temperature window, the thermal fluid ejector assembly including at least one printhead, the at least one printhead having a heat sink and a plurality of fluid drop ejectors, each fluid drop ejector having an ejector heater element usable to eject a drop of fluid in response to a main pulse, the method comprising:

(a) obtaining a measured temperature within the at least one printhead prior to ejecting a swath of fluid drops;

(b) comparing the measured temperature with a target operating temperature;

(c) determining an amount of heat energy necessary to raise the temperature of the at least one printhead to an initial temperature that is above the target operating temperature;

(d) prewarming the at least one printhead to the initial temperature using only heat energy produced by prepulses to at least one ejector heating element prior to ejecting a swath of fluid drops when the measured temperature is lower than the target operating temperature;

(e) heating the at least one printhead, while ejecting a swath of fluid drops, using only heat energy produced by applying prepulses and main pulses to the ejector heater elements of only those fluid drop ejectors that eject drops of fluid during the ejection of the swath of fluid drops; and (f) repeating steps (a), (b), (c), (d) and (e) after ejecting each swath of fluid drops such that the temperature within the at least one printhead remains within the operating temperature window during ejection of each swath of fluid drops.

8. The method of claim 7, wherein the target operating temperature is about 25° C.

9. The method of claim 7, wherein the operating temperature window is from about 10° C. to about 35° C.

10. The method of claim 7, wherein a number of prepulse signals required to prewarm the at least one printhead is determined based on the measured temperature and operating parameters of the at least one printhead.

11. The method of claim 7, wherein the prewarming step comprises applying respective prepulse signals to all ejector heating elements of the at least one printhead.

12. The method of claim 7, wherein one of a number of prepulse signals and a preheating time applied to the at least one ejector heating element is determined based on the measured temperature and data regarding measured temperature of the printhead.

13. The method of claim 7, wherein step (a) comprises measuring the temperature on the printhead using a temperature sensor located near a fluid channel within the printhead.

14. A method of prewarming a thermal fluid ejector assembly, the thermal fluid ejector assembly including at least one printhead, the at least one printhead having a heat sink and a plurality of drop ejectors, each drop ejector having an ejector heating element usable to eject a drop of fluid, the method comprising:

(a) obtaining a measured temperature within the printhead;

(b) comparing the measured temperature with a target operating temperature;

(c) determining an amount of heat energy necessary to raise the temperature of the at least one printhead to an initial temperature that is above the target operating temperature when the measured temperature is lower than the target operating temperature; and (d) prewarming the at least one printhead to the initial temperature using only heat energy produced by prepulses to at least one ejector heating element prior to ejecting a swath of fluid drops when the measured temperature is lower than the target operating temperature.

15. The method of claim 14, wherein the target operating temperature is about 25° C.

16. The method of claim 14, wherein step (a) comprises measuring the temperature on the printhead using a temperature sensoring device located near a channel within the printhead.

17. The method of claim 14, wherein a number of prepulse signals required to prewarm the at least one printhead is determined based on the measured temperature and operating parameters of the at least one printhead.

18. The method of claim 14, wherein the prewarming step comprises applying respective prepulse signals to all ejector heating elements of the at least one printhead.

19. The method of claim 14, further comprising repeating steps (a), (b), (c) and (d) after the ejection of each swath of fluid drops is completed.

20. A method of maintaining an operating temperature within an operating temperature window of a thermal fluid ejector assembly during an ejection of a swath of fluid drops, the thermal fluid ejector assembly including at least one printhead, the at least one printhead having a heat sink and a plurality of fluid drop ejectors, each fluid drop ejector having an ejector heater element usable to eject a drop of fluid, the method comprising:

assuring that an initial temperature of the printhead is higher than a target operating temperature prior to ejecting a swath of fluid drops; and heating the at least one printhead, while ejecting a swath of fluid drops, using only heat energy produced by applying prepulses and main pulses to the ejector heater elements of only those ejectors that eject drops of fluid during the ejection of the swath of fluid drops.

* * * * *